United States Patent [19]

Danger

[11] 4,096,213

[45] Jun. 20, 1978

[54] FAIL-SAFE CARBURETOR MIXTURE CONTROL

[76] Inventor: Jack N. Danger, 10628 N. 80th Dr., Peoria, Ariz. 85345

[21] Appl. No.: 828,832

[22] Filed: Aug. 29, 1977

[51] Int. Cl.[2] ..... F02M 7/14

[52] U.S. Cl. ..... 261/71; 261/DIG. 2; 123/198 D

[58] Field of Search ..... 261/71, DIG. 2; 123/198 D

[56] References Cited

U.S. PATENT DOCUMENTS

| | | | |
|---|---|---|---|
| Re. 22,984 | 3/1948 | Chandler | 261/DIG. 2 |
| 1,173,762 | 2/1916 | Arquembourg | 261/71 |
| 1,328,590 | 1/1920 | Royce | 261/71 |
| 1,367,326 | 2/1921 | Rackham | 261/71 |
| 2,088,464 | 7/1937 | Chandler et al. | 261/DIG. 2 |
| 2,399,077 | 4/1946 | Udale | 261/DIG. 2 |
| 3,927,657 | 12/1975 | Mennesson | 123/198 D |

*Primary Examiner*—Tim R. Miles
*Attorney, Agent, or Firm*—Herbert E. Haynes, Jr.

[57] ABSTRACT

An updraft carburetor of the type used on normally aspirated light aircraft engines and having a manually operable cable controlled mixture mechanism is provided with a biasing device which urges the mixture mechanism toward the full rich position to prevent engine failure in the event of cable failure.

8 Claims, 6 Drawing Figures

FAIL-SAFE CARBURETOR MIXTURE CONTROL

BACKGROUND OF THE INVENTION

1. Field of the Invention

This invention relates to carburetor mechanisms and more particularly to a fail-safe mixture control device for an updraft carburetor used on a normally aspirated aircraft engine.

2. Background of the Invention

Small aircraft which have normally aspirated engines are usually equipped with an updraft carburetor which, among other things, is provided with a mixture control valve. The mixture control valve is in the form of a rotary gate valve located within the fuel reservoir bowl of the carburetor and has a shaft extending externally of the carburetor body. A lever is attached to the extending end of the valve shaft and is movable through an arc of somewhat less than 90° from the full lean to full rich positions. One end of a control cable is attached to the valve lever with the opposite end having a suitable knob thereon, with the knob being suitably mounted in the cockpit area of the aircraft.

The valve shaft and attached lever are oriented on the carburetor body in a way which would cause the gate valve to rotate to a full lean mixture setting, due to gravitational forces and engine vibrations, were it not for the control cable. Thus, in the event of control cable failure, the carburetor will automatically and ultimately move to a full lean fuel-air mixture setting.

As is well known, flying, landing and general aircraft operation at low density altitudes requires a relatively lean fuel-air mixture ratio. Low density altitudes, which are determined by altitude, temperature and barometric pressure, normally occur at altitudes of approximately 5,000 ft., or more, indicated mean sea level. Even so, control cable failure, as described above, will present a safety hazard in low density altitude flying as well as in high density altitude flying (usually below 5,000 ft. M.S.L.) in that when the mixture control valve is in the full lean mixture setting, the aircraft engine will be starved for fuel and engine failure will result.

It will now be seen that the above described prior art mixture control system presents a safety hazard in all flying situations.

If the prior art mixture control mechanism were configured in a way so that cable failure caused the gate valve to move to a full rich fuel-air mixture ratio setting, the problem would not be as critical in that some loss in power and performance would be experienced at high altitudes but a high altitude landing could be made, and no power and performance loss would be experienced in low altitude flying.

To the best of my knowledge, no method or device has been devised or suggested which would cause the mixture control valve of an updraft carburetor on a normally aspirated aircraft engine to move toward the full rich fuel-air mixture position in the event of control cable failure.

Therefore, a need exists for a fail-safe carburetor mixture control mechanism which eliminates, or at least substantially reduces, the safety hazard of the prior art.

SUMMARY OF THE INVENTION

In accordance with the present invention, a new and useful fail-safe mixture control device is disclosed for use with an updraft carburetor on a normally aspirated aircraft engine. The fail-safe mixture control device of the present invention includes biasing means coupled to the carburetor and the rotary mixture control valve to urge that valve toward the full rich fuel-air mixture setting of that valve and a positive locking control cable means which is coupled between the aircraft's cockpit and the mixture control valve to position and hold the valve at the selected mixture setting and prevent unwanted movements thereof which would otherwise occur due to the biasing means. In this manner, any desired fuel-air mixture ratio can be selected by appropriate positioning of the mixture control valve, and in the event of control cable failure, the valve will be urged toward the full rich fuel-air mixture position.

Accordingly, it is an object of the present invention to provide a new and useful fail-safe mixture control device for use with an updraft carburetor on a normally aspirated aircraft engine.

Another object of the present invention is to provide a new and useful fail-safe fuel mixture control device for use with an updraft carburetor on a normally aspirated aircraft engine, with the device causing the carburetor's mixture control valve to move toward a rich fuel-air mixture ratio setting in the event of control cable failure.

Another object of the present invention is to provide a new and useful fail-safe fuel mixture control device of the above described character which includes biasing means for urging the carburetor's fuel mixture control valve toward the full rich fuel-air mixture setting of that valve.

Still another object of the present invention is to provide a new and useful fail-safe fuel mixture control device of the above described character which includes biasing means for urging the carburetor's mixture control valve toward the full rich setting thereof and a positive locking control cable means for positioning and fixedly holding the carburetor's mixture control valve at desired settings.

The foregoing, and other objects of the present invention, as well as the invention itself will be more fully understood from the following description when read in conjunction with the accompanying drawings.

DESCRIPTION OF THE PREFERRED EMBODIMENTS

Figure 1:
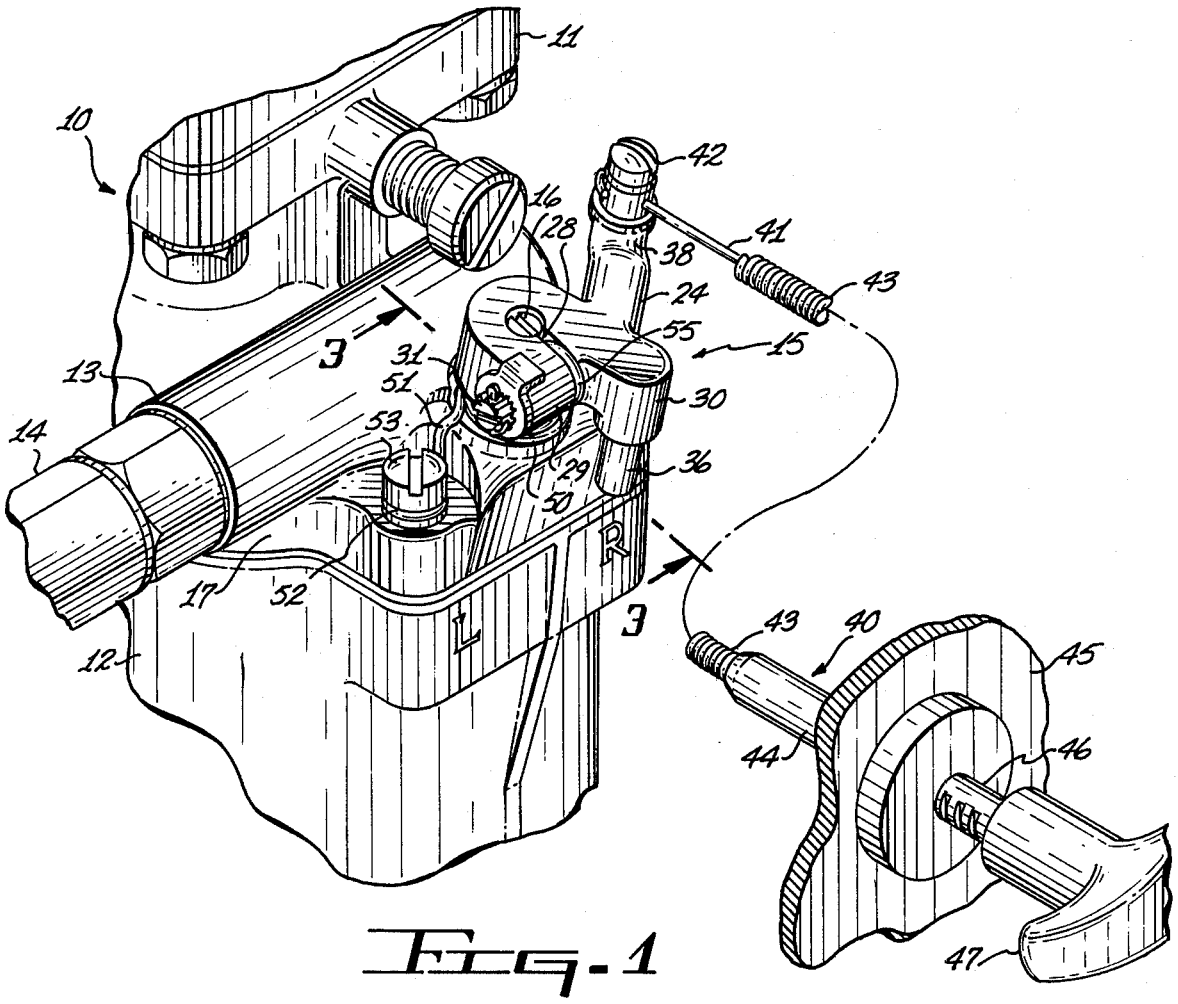
FIG. 1 is a fragmentary isometric view showing an updraft carburetor of the type used on normally aspirated aircraft engines and having a first embodiment of the fail-safe mixture control mechanism of the present invention mounted thereon.

Referring more particularly to the drawings, FIG. 1 illustrates a fragmentary portion of an updraft carburetor of the type used on normally aspirated aircraft engines, with the carburetor being indicated generally by the reference numeral 10, and with the aircraft engine not being shown.

As is well known in the art, the carburetor 10 includes a mounting flange 11 for mounting thereof to an engine (not shown), and is provided with the usual fuel reservoir bowl 12 and fuel inlet boss 13 to which a suitable fuel inlet line 14 is connected. A typical carburetor of this type, such as the one manufactured by the Marvel Schebler Company, a Division of the Borg Warner Corp. of Decatur, Ill. and including those carburetors identified by the Model Nos. MA3, MA4 and MA4-5, also includes a mixture control valve in the form of a rotary gate valve 15 by which the fuel-air mixture ratio setting of the carburetor is controlled.

For completeness of this description, the mixture control valve 15 of the carburetor 10 will now be described in detail, with it being understood that this description will not include the description of the mechanism of the present invention as that latter description will follow the description of the mixture control valve 15.

Figure 6:
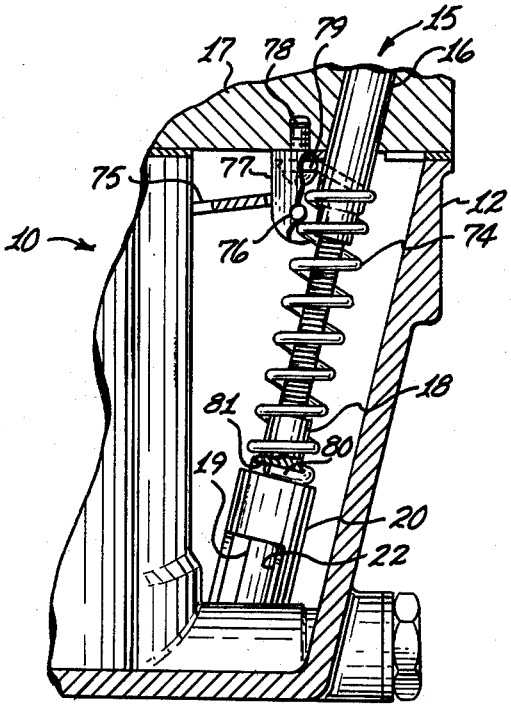
FIG. 6 is an enlarged fragmentary sectional view taken substantially along the longitudinal axis of the carburetor's rotary mixture control valve and showing a third embodiment of the mechanism of the present invention mounted thereon.

As seen best in FIGS. 1 and 6, the mixture control valve 15 of the carburetor 10 includes an elongated shaft 16 rotatably mounted in the top or cover casting 17 of the carburetor 10 with the shaft 16 having one end extending into the fuel bowl 12, with that end of the rotatable shaft 16 having a tubular sleeve 18 mounted thereon. The sleeve 18 is fixed for rotation with the shaft 16 and has an axially extending slot 19 formed therein. The sleeve 18, which will hereinafter be referred to as the rotatable sleeve, is coaxially nestably positioned in upwardly opening bore of a fixed sleeve 20 which is mounted in the bottom of the fuel bowl 12 so as to be in communication with the internal fuel passages (not shown) of the carburetor 10. The fixed sleeve 20 is also provided with an axially extending slot 22 so that rotation of the rotary sleeve 18 in the bore of the fixed sleeve 20 will appropriately position the slots 19 and 22 relative to each other so as to meter the flow of fuel from the bowl 12 into the fuel delivery passages (not shown) of the carburetor 10.

The other end of the rotatable shaft 16 extends from the cover 17 of the carburetor 10 and has a crank lever 24 demountably attached thereto, with a spring 25 (FIG. 3) being coaxially mounted on that extending end of the shaft 16 between the cover 17 and the lever 24 to bias the mixture control valve 15 into a desired operating position. The crank lever 24 has a body portion 26 with a bore 27 formed therethrough and is provided with a slot 28 extending radially from the bore 28 between a pair of laterally extending ears 29 and 30. A suitable screw 31, having a locking washer 32, is loosely carried in a bore 33 (FIG. 2) formed transversely through the ear 29, and is threadingly mounted in a threaded bore 34 (FIG. 3) transversely formed in the ear 30 so that threaded movement of the screw 31 will move the ears 29 and 30 toward or away from each other to demountably clamp the rotatable shaft 16 in the bore 27 of the crank lever 24.

A stop pin 36 is integrally formed on the laterally extending ear 30 so as to depend therefrom. As will hereinafter be described, the mixture control valve 15 is rotatable through an arc of somewhat less than 90° between full lean and full rich fuel-air mixture settings, and the stop pin 36 limits the rotary movement of the mixture control valve 15 by moving between two separated points of engagement with the carburetor body.

The crank lever 24 also has a laterally extending control arm 38 by which rotary movements of the mixture control valve 15 are produced and controlled from a remote location as will hereinafter be described in detail.

In the absence of any mechanism connected to the control arm 38, as will hereinafter be described, the mixture control valve 15 rotates in a clockwise direction toward the lean fuel-air mixture setting which is indicated on the carburetor body by the letter L in FIG. 1. Such rotation is caused by gravitational forces and the normal engine vibrations acting on the crank lever 24 to move the laterally extending control arm 38 and stop pin 36 about the angularly disposed longitudinal axis of the rotatable shaft 16.

As is customary in installations of the carburetor 10, the mixture control valve 15 is controlled by a conventional friction type cable assembly (not shown) which is coupled to the control arm 38 and extends into the cockpit of the airplane (not shown). In accordance with the present invention, the usual control cable (not shown) is replaced by a special control cable which is indicated generally by the reference numeral 40 in FIG. 1. The control cable 40 includes the usual elongated wire 41 which is suitably coupled on one end thereof to the control arm 38 such as by the locking means 42. The wire 41 is slidably mounted in a flexible tubular housing 43 which is fixed to a cable locking housing 44 mounted on a suitable surface such as the instrument panel 45 of the aircraft. The opposite end of the wire 41 is coupled in the usual well known manner to the notched shank 46 of a pull knob 47. Such control cables are well known in the art and are of the positive locking type, which upon approximately a 90° rotation of the knob 47 will be free for sliding movement into or out of the cable locking housing 44. Rotation of the knob 47 back to its original position will lock the knob 47, its shank 46 and the wire 41 against unwanted movement.

As hereinbefore described, cable failure creates a safety hazard in that the mixture control valve 15 will move to the lean fuel-air mixture setting upon such failure. In accordance with the present invention, such a safety hazard is eliminated by providing a biasing means which operates to cause the mixture control valve 15 to move toward the full rich fuel-air mixture setting.

Figure 2:
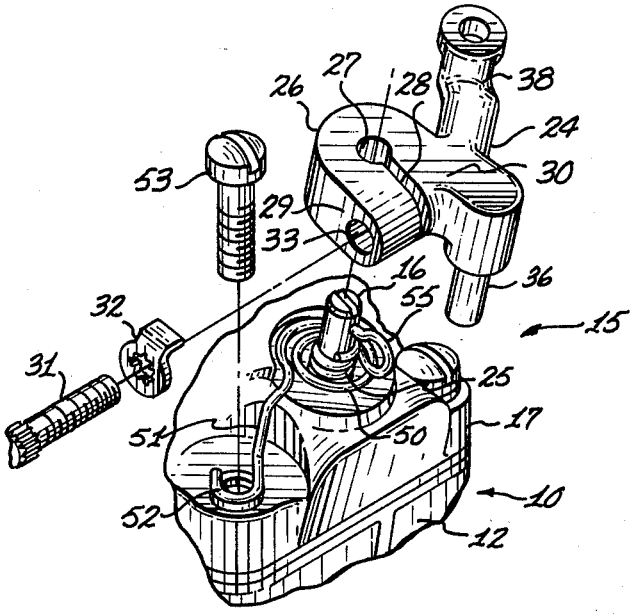
FIG. 2 is a fragmentary isometric view similar to FIG. 1 and having the carburetor's mixture control valve lever exploded therefrom to more clearly show the first embodiment of the mechanism of the present invention.
Figure 3:
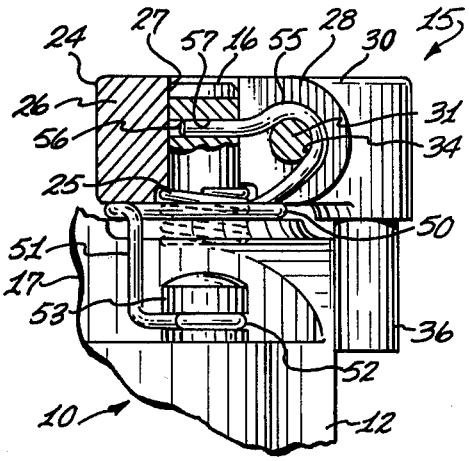
FIG. 3 is an enlarged fragmentary sectional view taken substantially along the longitudinal axis of the carburetor's mixture control valve to illustrate the relationship thereof with respect to the first embodiment of the mechanism of the present invention.

FIGS. 1, 2 and 3 illustrate the preferred form of the biasing means as a concentrically wound coil spring 50 which is coaxially positioned to circumscribe the extending end of the rotatable shaft 16. The outwardly positioned portion 51 of the coil spring 50 is bent so that it extends substantially radially therefrom and conforms to the irregular top surface to the carburetor cover casting 17 and is formed with a loop 52 on the end thereof. The portion 51 and end loop 52 form an anchor tail for the coil spring 50 which is secured in place by one of the screws 53 which are used to attach the carburetor cover casting 17 to the fuel bowl portion 12. The inwardly disposed portion of the coil spring 50 is bent upwardly (FIG. 3) into a loop 55 which is positioned in the radial slot 28 of the crank lever 24 so as to wrap around the shank of the screw 31 which is employed to clampingly secure the crank lever 24 to the rotatable shaft 16. The extreme free end 56 of the coil spring 50 is positioned so that it is received and captively retained in a transverse bore 57 formed adjacent the extending end of the rotatable shaft 16.

The coil spring 50 configured and mounted as described above will urge the mixture control valve 15 toward the full rich fuel-air mixture setting which is indicated by the letter R on the carburetor body in FIG. 1. It will be understood that the coil spring 50 can be wound so that the mixture control valve 15 will move to the full rich setting, or can alternately be wound so that the mixture control valve 15 will rotate to a position somewhat less than full rich, such as a three-quarter rich setting.

It will, therefore, be seen that the fail-safe mixture control mechanism of the present invention comprises biasing means for urging the mixture control valve 15 toward the full rich fuel-air mixture setting and a positive locking cable means for setting and positively holding the mixture control valve 15 at a desired setting.

Figure 4:
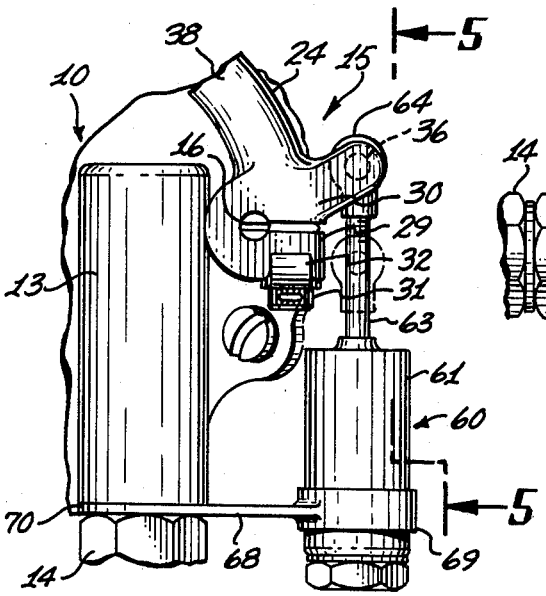
FIG. 4 is a fragmentary plan view of the updraft carburetor having a second embodiment of the mechanism of the present invention mounted thereon.
Figure 5:
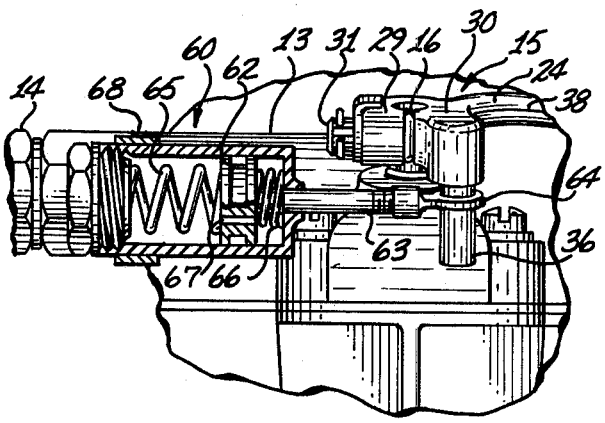
FIG. 5 is a fragmentary side elevational view of the mechanism shown in FIG. 4 and partially broken away to illustrate the various features thereof.

Reference is now made to FIGS. 4 and 5 wherein a second embodiment of the biasing means is shown to include a linear actuator which is indicated generally by the reference numeral 60. The linear actuator 60 includes a cylindrical housing 61 in which a piston 62 is slidingly reciprocally mounted, and the piston has a piston rod 63 integrally formed thereon. The piston rod 63 is provided with an eye 64 on the extending end thereof which circumscribes the stop pin 36 of the crank lever 24. The piston rod 63 is urged to the extended position, solid lines in FIG. 4, by a first spring 65 mounted in the housing 61 so as to exert a biasing force on one side of the piston 62. A damper spring 66 is mounted within the cylindrical housing 61 so as to engage the opposite side of the piston 62 to provide a dash-pot effect. The bore of the cylindrical housing 61 may be filled with any suitable fluid such as air, oil or the like which will migrate from one side of the piston 62 to the other during operation of the linear actuator 60 by means of a suitable orifice 67 formed through the piston 62. The linear actuator 60 is mounted on the carburetor 10 by a bracket 68 which has a suitable loop structure 69 formed on one end thereof which grippingly engages the periphery of the cylindrical housing 61. The opposite end 70 of the bracket 68 is grippingly held between fuel inlet line fittings 14 and the fuel inlet boss 13 of the carburetor 10.

Reference is now made to FIG. 6 wherein a third embodiment of the biasing means is shown as a coil spring 74 which is mounted internally of the carburetor 10. As is customary, the cover casting 17 of the carburetor 10 has the fuel float assembly 75 (partially shown) pivotably suspended therefrom by a pivot pin 76 carried in a suitable yolk 77. The yolk 77 is affixed to the under surface of the cover casting 17 by screws 78 (one shown). One end of the spring 74 is formed with a loop 79 which is captively retained under one of the screws 78, and the spring coils downwardly from the loop 79 coaxially around the rotatable shaft 16 of the mixture control valve 15. The other end 80 of the coil spring 74 is affixed to the rotatable shaft 16 by being captively retained in a transverse bore 81 formed in the rotatable sleeve 18 of the mixture control valve.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A fail-safe mixture control mechanism for use on an updraft carburetor of a normally aspirated aircraft engine, said carburetor having a fuel mixture control valve rotatably movable between lean and rich fuel-air mixture positions and including a rotatable shaft in and extending from the fuel bowl of the carburetor with a crank lever on the extending end of said shaft, said fail-safe mixture control mechanism comprising:

(a) a positive locking control cable means having one end attachable to the crank lever of the carburetor's mixture control valve for lockingly holding the mixture control valve in selected positions when attached to the crank lever thereof; and (b) biasing means having one end attachable to the carburetor and the other end attachable to the mixture control valve of the carburetor for biasingly urging the mixture control valve toward the rich fuel-air mixture position thereof.

2. A fail-safe mixture control mechanism as claimed in claim 1 wherein said biasing means comprises a coil spring coaxially mountable on the extending end of the rotatable shaft of the carburetors mixture control valve.

3. A fail-safe mixture control mechanism as claimed in claim 1 wherein said biasing means comprises:

(a) a coil spring coaxially mountable on the extending end of the rotatable shaft of the carburetor's mixture control valve between the carburetor body and the crank lever of the carburetors mixture control valve;

(b) said coil spring having one end thereof attachable to the body of the carburetor; and (c) said coil spring having the other end thereof attachable to the crank lever and to the rotatable shaft of the carburetor's mixture control valve.

4. A fail-safe mixture control mechanism as claimed in claim 1 wherein the crank lever of the carburetor's mixture control valve includes a body having a bore in which the extending end of the rotatable shaft is received with the body having a slot radially extending from the bore thereof between a pair of laterally extending ears in which an ear moving screw is transversely mounted for clampingly holding the crank lever on the rotatable shaft, and wherein said biasing means comprises:

(a) a coil spring coaxially mountable on the extending end of the rotatable shaft of the carburetor's mixture control valve between the carburetor body and the crank lever of the mixture control valve;

(b) said coil spring concentrically wound to provide an outwardly disposed portion and an inwardly disposed portion;

(c) said outwardly disposed portion of said coil spring attachable to the carburetor's body; and (d) said inwardly disposed portion of said coil spring positionable in the slot of the crank lever of the carburetor's mixture control valve and configured to wrap around the ear moving screw thereof.

5. A fail-safe mixture control mechanism as claimed in claim 4 wherein the rotatable shaft of the carburetor's mixture control valve is provided with a transverse bore adjacent the extending end thereof for captively retaining the extreme end of said inwardly disposed portion of said coil spring.

6. A fail-safe mixture control mechanism as claimed in claim 1 wherein said biasing means comprises:

(a) a linear actuator mountable on the carburetor's body;

(b) said linear actuator having an extensible rod movable between an extended position and a retracted position;

(c) spring means in said linear actuator for biasingly urging said extensible rod to the extending position thereof; and (d) means for coupling said extensible rod to the crank lever of the carburetor's mixture control valve.

7. A fail-safe mixture control mechanism as claimed in claim 1 wherein said biasing means comprises:

(a) a cylindrical housing having a piston reciprocally mounted therein;

(b) a piston rod affixed to said piston and movable therewith between an extended position and a retracted position of said piston rod;

(c) spring means in said housing for exerting a biasing force on said piston to urge said piston rod to the extended position thereof;

(d) means for coupling said piston rod to the crank lever of the carburetor's mixture control valve; and (e) bracket means for attaching said cylindrical housing to the body of the carburetor.

8. A fail-safe mixture control mechanism as claimed in claim 1 wherein said biasing means comrises a coil spring for positioning within the fuel bowl of the carburetor in coaxial relationship with the rotatable shaft of the carburetor's mixture control valve, one end of said coil spring being attachable to the carburetor's body and the opposite end being attachable to the rotatable shaft of the carburetors's mixture control valve.

* * * * *